US006799433B1

(12) United States Patent
Gleason et al.

(10) Patent No.: US 6,799,433 B1
(45) Date of Patent: Oct. 5, 2004

(54) PORTABLE FOOD COOLING CONTAINER

(76) Inventors: Patrick T. Gleason, 5441 Hisey Ranch Rd., Acton, CA (US) 93510; Penny A. Gleason, 5441 Hisey Ranch Rd., Acton, CA (US) 93510

( * ) Notice: Subject to any disclaimer, the term of this patent is extended or adjusted under 35 U.S.C. 154(b) by 129 days.

(21) Appl. No.: 10/407,717

(22) Filed: Apr. 4, 2003

(51) Int. Cl.[7] ..... F25O 3/08
(52) U.S. Cl. ..... 62/457.9; 62/407
(58) Field of Search ..... 62/3.62, 3.2, 457.1, 62/457.6, 457.9, 407

(56) References Cited

U.S. PATENT DOCUMENTS 3,710,589 A * 1/1973 Brown et al. ..... 62/457.2
3,862,547 A 1/1975 Ishammar
4,351,164 A 9/1982 Christiani
5,345,784 A 9/1994 Bazemore et al.
5,423,194 A * 6/1995 Senecal ..... 62/457.6
5,718,124 A * 2/1998 Senecal ..... 62/457.6
6,295,820 B1 * 10/2001 Cauchy et al. ..... 62/3.6

* cited by examiner

*Primary Examiner*—Melvin Jones
(74) *Attorney, Agent, or Firm*—Aaron T. Borrowman; Kelly Bauersfeld Lowry & Kelley, LLP

(57) ABSTRACT

A portable refrigeration apparatus includes a base defining an open interior cavity. An electric refrigeration unit is operably disposed in the base for cooling the contents of the interior cavity. A food container is configured to be removably disposed within the interior cavity of the base. Preferably, a vent is formed between the base and the food container to permit cool air to flow above the food container. A lid is positionable over the food container and configured to be removably placed onto an upper edge of the base to form a generally air-tight seal therebetween.

21 Claims, 4 Drawing Sheets

PORTABLE FOOD COOLING CONTAINER

BACKGROUND OF THE INVENTION

The present invention generally relates to refrigeration units. More particularly, the present invention relates to a food cooling container which is designed in size so as to be portable for placement on counter tops, used for picnics, pot-luck events and the like.

While the refrigerator is an excellent tool for keeping perishable food items fresh, there are certain drawbacks associated with their use. Foremost is the fact that the perishable foods must be kept inside the refrigerator in order to last any period of time. However, items such as fruit and vegetables which are stored in areas of the refrigerator which are not readily seen or frequently accessed can go unnoticed until they begin to spoil. However, placing fruit or vegetables on a kitchen counter, while more easily noticed, severely limits their life span as spoilage occurs at a faster rate. Moreover, such foods are often more desirable when cool. Furthermore, salad greens and vegetables tend to wilt and dry out when stored in conventional vessels.

Similar problems are often encountered while hosting a dinner, or during pot-luck events. Lettuce tends to wilt and cheese dries out when serving such perishables in the traditional manner. Foods containing mayonnaise, eggs, or milk are particularly susceptible to food spoilage even within an hour or two.

In restaurants and other places with self-service buffets, tables and counters are often provided with cooling wells in the table or countertop for such food that must be kept cold to preserve its quality. Such cooling wells comprise box-shaped recesses or depressions in a table or counter top with external surrounding cooling tubes or a cooling jacket. However, such commercial cooling wells are often not available to the typical home owner or dinner host. Moreover, such cooling wells and tables are very expensive, occupy a significant amount of space, are not portable and also have disadvantages. For example, even in such restaurant settings, the displayed food will gradually become wilted, dried out or otherwise drab and unappetizing.

Picnics and cookouts are popular recreational pastimes during the summer months. Oftentimes, food is catered, such as to the movie industry, in an outdoor setting as well. A potential hazard for outdoor eating, however, is food spoilage. Such foods are often kept in a picnic cooler up until serving time. However, once people begin to eat, such foods are usually moved from the cooler and placed on the serving table, where it may sit for several hours while people eat, talk, play games, etc. Particularly in the summer months, the food is very susceptible to drying out, wilting and spoilage.

Attempts have been made in the past to overcome these problems. For example, U.S. Pat. No. 4,520,633 relates to a salad bowl having a relatively flat interior partition separating the bowl into an upper food containing receptacle and a lower ice-containing chamber. U.S. Pat. No. 5,345,784 discloses a salad bowl comprising interior and exterior bowls, with a cooling chamber filled with cold water or the like therebetween. However, these devices only serve to keep food cool for a very short period of time. Moreover, these devices do not address the problems associated with wilting and drying of the surface of the food to be served. Moreover, these devices can be messy in that the water can spill from these devices on the serving table as the food is removed from the containers, or they are transported.

Accordingly, there is a continuing need for a food cooling container which overcomes the problems discussed above and takes into account the drawbacks associated with prior devices and systems. The present invention fulfills these needs and provides other related advantages.

SUMMARY OF THE INVENTION

The present invention resides in a portable refrigeration apparatus which is sized such so as to be placed upon one's counter top, or even transported in one's car or the like. The refrigeration apparatus of the present invention can be used for prolonged periods of time so long as a power source, such as an electrical outlet or battery power, is supplied thereto. The apparatus of the present invention is intended to overcome the problems associated with forgotten food in refrigerators, unappetizing drying and wilting of exposed foods, as well as spoilage of foods left out for prolonged periods of time.

The refrigeration apparatus of the present invention generally comprises a base having a circumferential wall defining an open interior cavity. The base is preferably insulated, and may comprise a dual wall having an insulating space therebetween. An electric refrigeration unit is operably disposed in the base for cooling the contents of the interior cavity. The refrigeration unit typically comprises a compressor, a cooling coil coupled to the compressor, and a fan for directing cool air into the interior cavity. A temperature control mechanism and dial may be coupled to the refrigeration unit to alter the temperature of the interior cavity.

A food container is provided which is configured to be removably disposed within the interior cavity of the base. A wall having apertures may be disposed, or formed, in the base between the refrigeration unit and the food container. The food container may be generally solid, or include a plurality of apertures therethrough for permitting cool air to flow into the food container. The food container may also be compartmentalized to accommodate different food items.

A lid is positionable over the food container, and is preferably configured to form a generally air-tight seal between it and an upper edge of the base.

A vent is formed between the base and the food container to permit cool air to flow above the food container. The vent can take many forms, including an irregular ledge supporting a rim of the food container to permit passage of cool air between the base and the rim of the food container. More preferably, however, the vent comprises apertures formed in an upper portion or rim of the food container for permitting cool air to flow therethrough.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 5:
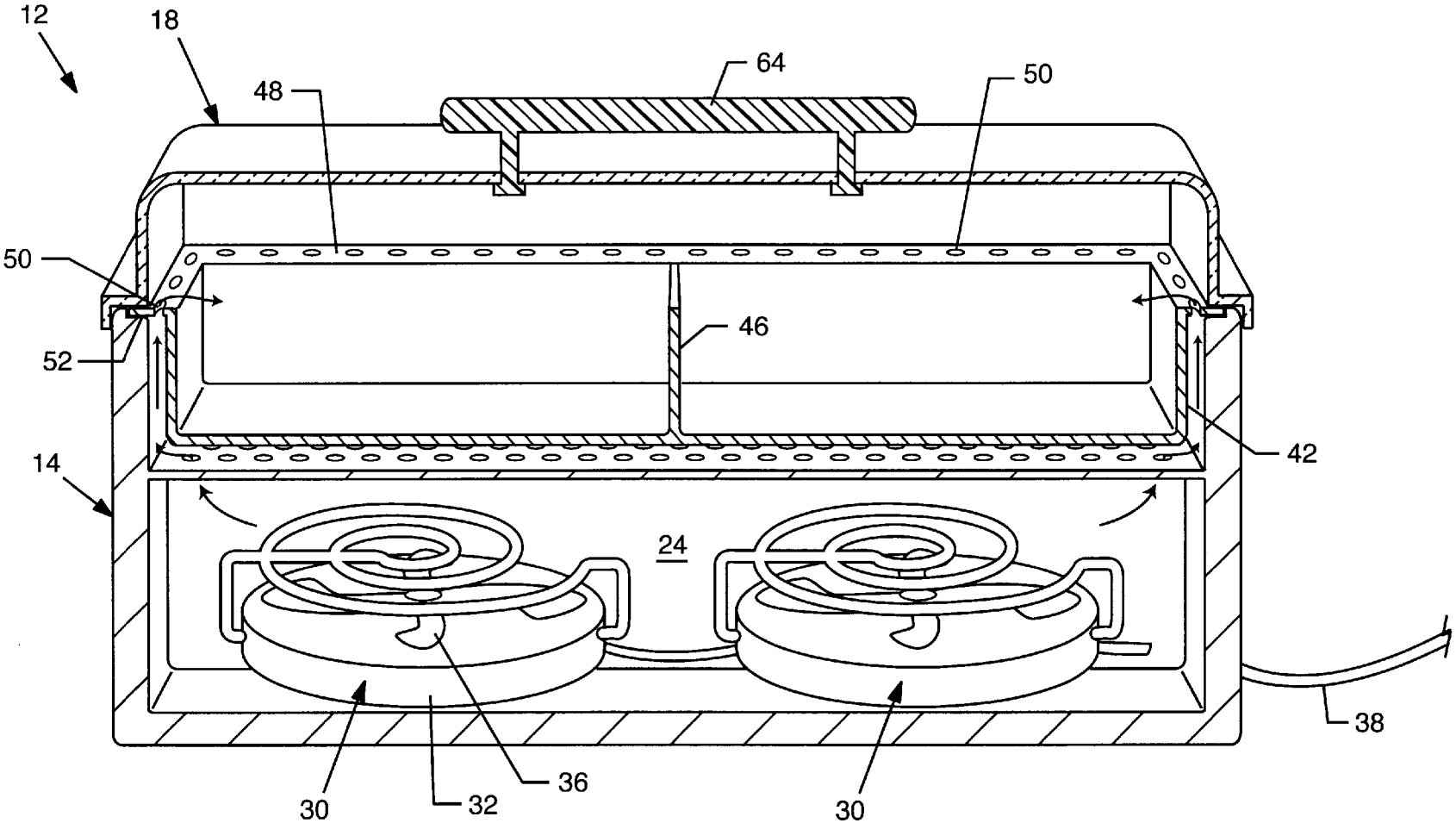
FIG. 5 is a cross-sectional view of yet another refrigeration apparatus embodying the present invention, having a generally rectangular configuration and multiple refrigeration units therein.

As shown in the accompanying drawings for purposes of illustration, the present invention resides in a refrigeration apparatus, generally referred to by the reference number 10 in FIG. 14, and by the reference number 12 in FIG. 5. As will be more fully described herein, the refrigeration apparatus 10 and 12 is designed so as to be portable for conveniently holding food items to be refrigerated on a counter or serving table for prolonged periods of time.

Figure 1:
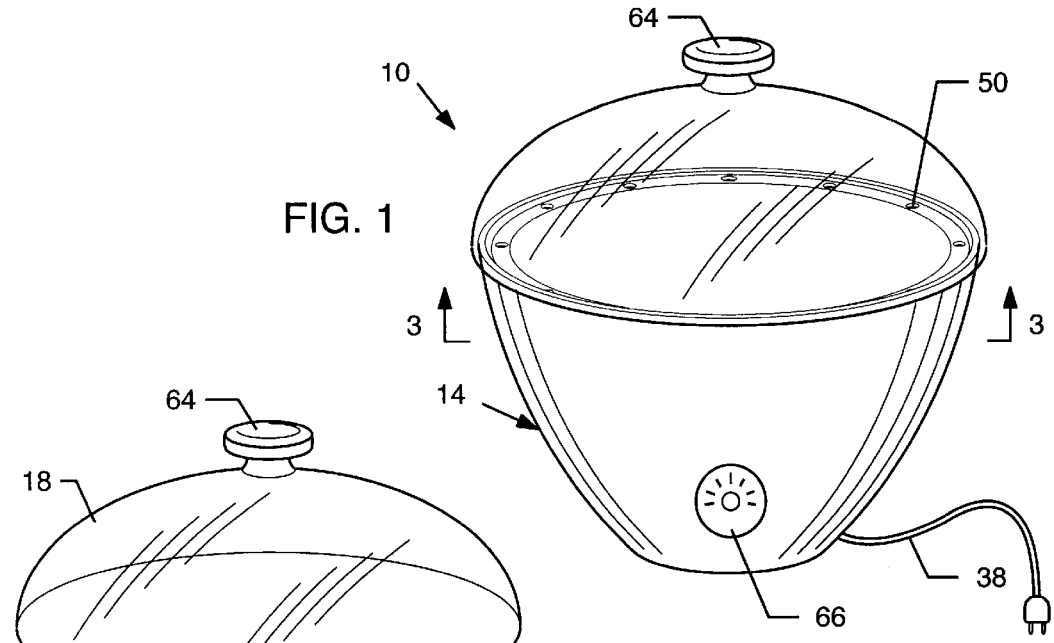
FIG. 1 is a perspective view of a portable food cooling container embodying the present invention.
Figure 2:
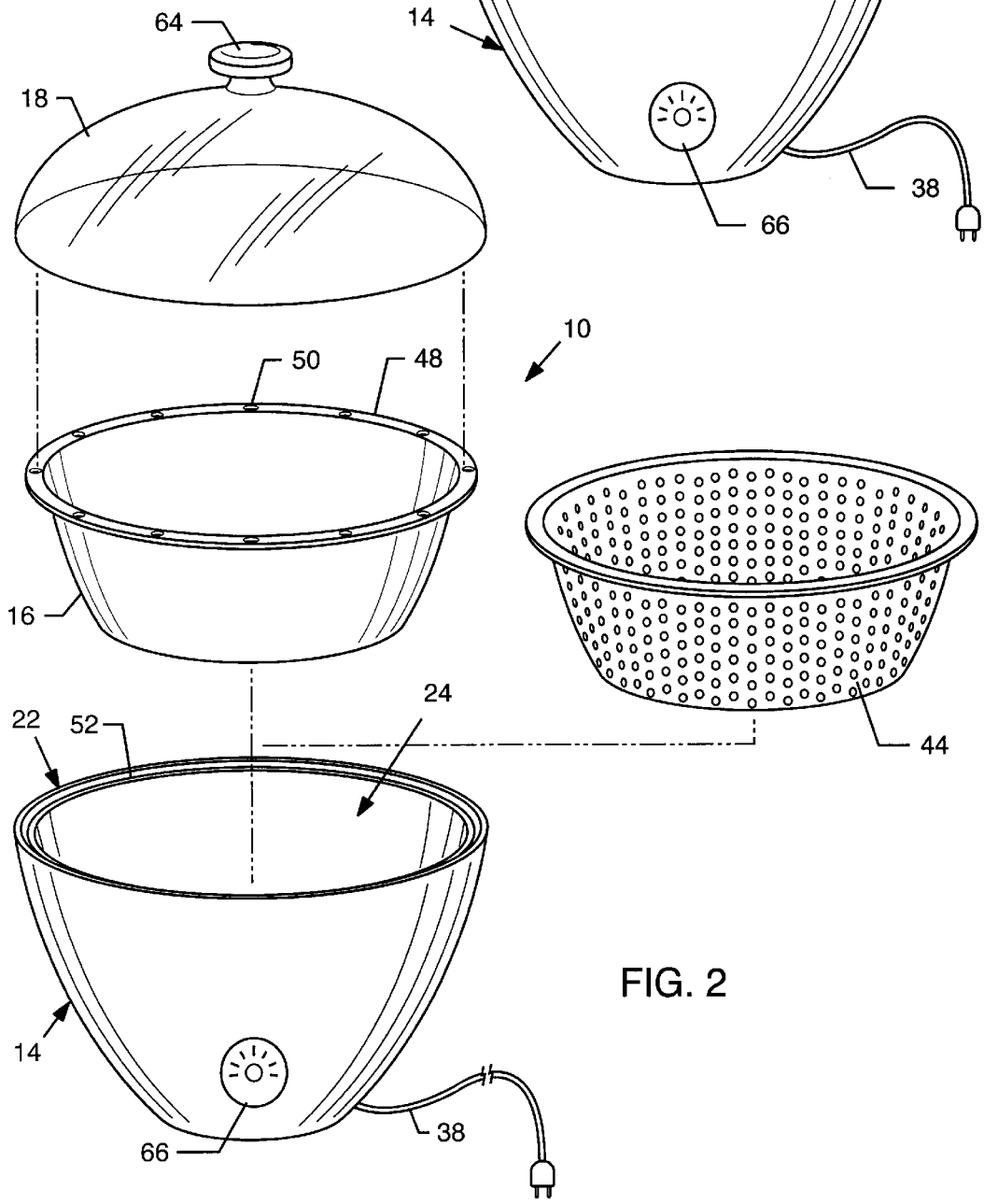
FIG. 2 is a partially exploded perspective view of the food container of FIG. 1, illustrating the use of either a solid or apertured food container.

With reference to FIGS. 1 and 2, the apparatus 10 is generally comprised of a base 14 which removably supports a food container 16 and a lid 18 which is designed to be placed over the food container 16 and in a particularly preferred embodiment form a generally air-tight seal between it and the base 14 to retain cool air within the apparatus 10. The apparatus 10 is sized such so as to be stored on a counter top or easily placed on a serving table or the like. The apparatus 10 can be of many different configurations, although it is typically a bowl-shaped, square or rectangular pan-shaped configuration.

Figure 3:
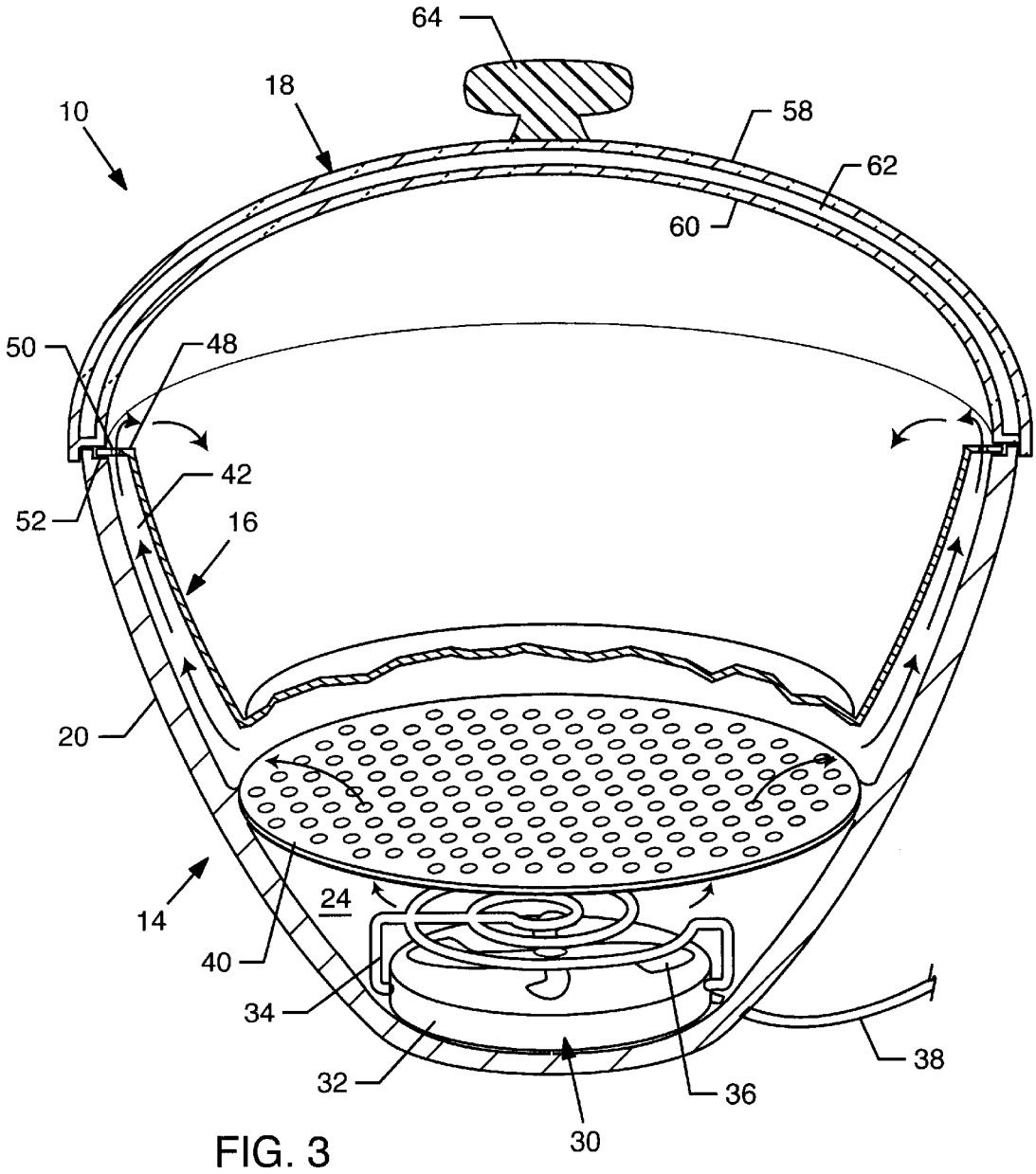
FIG. 3 is a cross-sectional view taken generally along line 3—3 of FIG. 1, illustrating the flow of cool air generated by a refrigeration of the apparatus.
Figure 4:
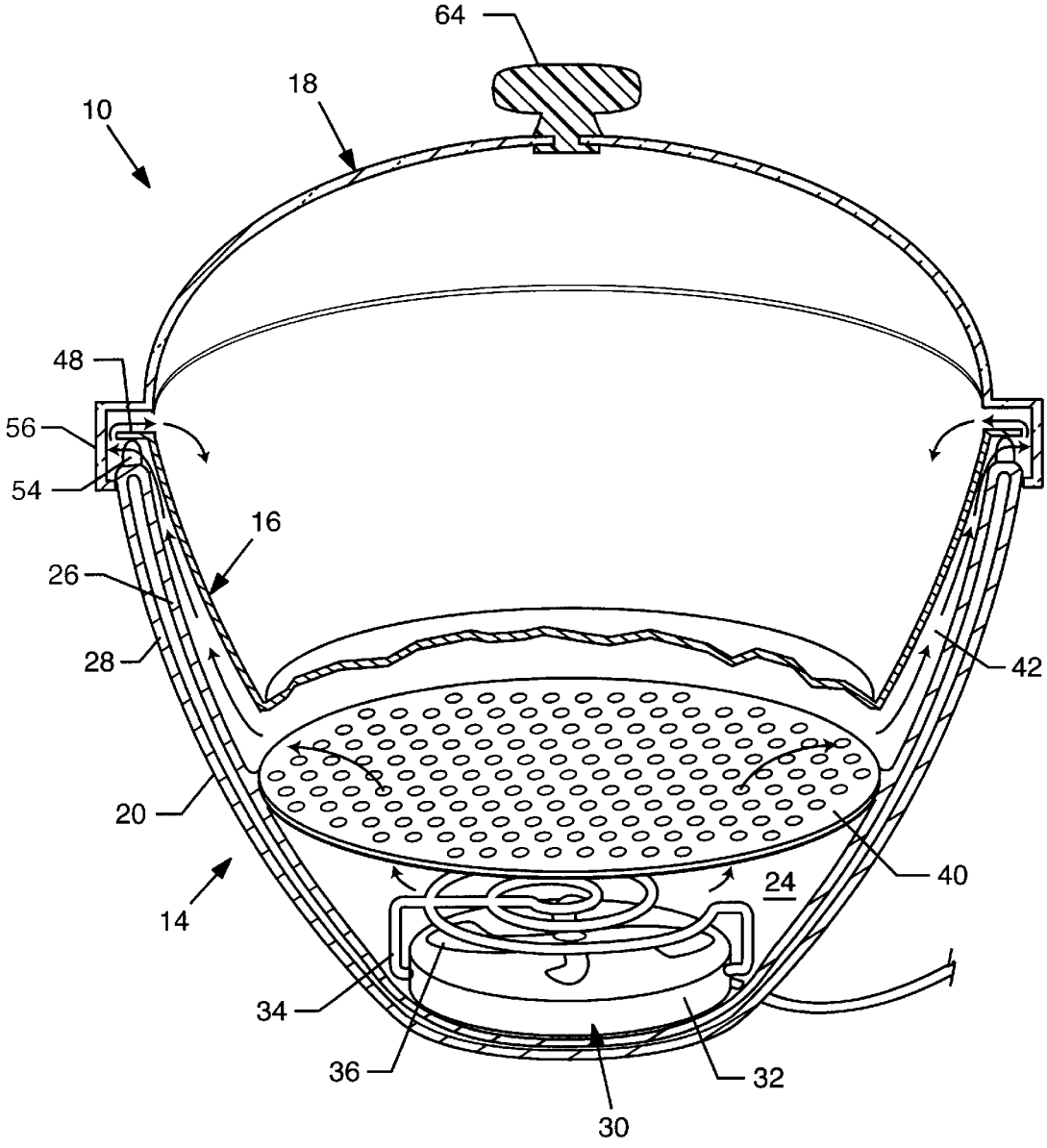
FIG. 4 is a cross-sectional view of the apparatus similar to FIG. 3, illustrating another vent means used in accordance with the present invention.

With reference now to FIGS. 1–4, the base 14 is comprised of a circumferential wall 20 having an upper edge 22 which is configured to support the food container 16 thereon. Thus, the base 14 defines an internal cavity 24 which is open to the environment. The wall 20 may be comprised of an insulating type material, or have insulative material attached to an inner surface thereof. Typically, the base 14 is comprised of a metal material, although such can vary and incorporate plastics or earthware as deemed appropriate. The base 14 in a particularly preferred embodiment, as illustrated in FIG. 4, is comprised of an outer wall 20 and an inner wall 26 having an insulative space 28 there between so that cold air is not released to the environment, as will be described more fully herein.

With particular reference to FIGS. 3 and 4, a refrigeration unit 30 is disposed within the base for cooling the internal cavity 24 thereof. The refrigeration unit 30 is comprised of a compressor 32 operably connected to a cooling coil 34 such that the air with the internal cavity 24 is cooled. Preferably, the refrigeration unit 30 includes a fan 36 for passing air over the condensing coil 34 so as to circulate the cooled air. It will be appreciated by those skilled in the art, that other refrigeration units which are known in the art could be substituted for the cooling unit 30 described above. An electrical cord 38 extends from the refrigeration unit 30 for powering the apparatus 10, such as by a household 110 volt electrical outlet. It will also be appreciated by those skilled in the art that the present invention can include an adapter such that the apparatus 10 can be powered by a cigarette lighter of an automobile, or by an alternative power source, such as a battery. In this manner, cool air can be created within the internal cavity 24 while in the car such as when transporting the food to a potluck dinner, picnic, etc. Battery power may be desirable in certain other instances, such as outdoor catering and the like.

With continuing reference to FIGS. 3 and 4, an apertured wall 40 is disposed in a lower portion of the base 14 above the refrigeration unit 30, or formed integrally with the base 14 so as to protect the refrigeration unit 30 while allowing air (shown by the arrows) to flow therethrough. Such wall 40 is optional, instead the food container 16 can be configured such so as to not make contact with refrigeration unit 30 under virtually any circumstance. However, wall 40 serves not only to protect refrigeration unit 30, but also prevent small items from dropping onto refrigeration unit 30, or children's fingers from being harmed by fan 36.

The food container 16 is comprised of any suitable material, including metal or plastic. The food container 16 is generally configured so as to substantially mate with an inner surface of base 14. Typically, the food container 16 is sized such that a small gap 42 defining an air passageway is formed between an outer surface thereof and an inner surface of the base 14 such that cool air can flow therebetween and cool the entire outer surface of the container 16, and thus the food therein.

A bowl-shaped container 16 is illustrated in FIG. 14. However, the container is not restricted to this configuration and can be generally rectangular, as illustrated in FIG. 5, or of any other configuration so long as it is removably disposed within base 14. The container may include a plurality of apertures so as to form a colander-like container 44, as illustrated in FIG. 2. Such container is particularly useful for vegetables and fruit. However, for wetter food items, such as Jell-O, ambrosia, casseroles or salads, the container 16 is solid in construction so as not to allow the food contents thereof to leak into the base 14. The container 16 can be of varying depths so as to accommodate different foods. For example, the container 16 can be relatively shallow so as to serve as a relish tray or the like. The container 16 may include internal walls 46 for creating compartments for the placement of different food items. For example, in a relish tray container, a central portion can define a dip compartment, with separate compartments for olives, carrot sticks, etc. Even deeper dish containers 16 could include such internal walls 46 so that different salads can be maintained in the same unit 10 or 12.

In a particularly preferred embodiment, the apparatus 10 includes vents so that the cool air can travel above the food container 16 to prevent drying and wilting of the upper surface of food stored therein. As illustrated in FIGS. 2, 3 and 5, an upper rim 48 of the food container 16 can include vent apertures 50. The rim 48 rests upon a ledge 52 or shoulder formed on the upper rim 22 of the base 14. Cool air flowing within gap 42 is allowed to flow through vent apertures 50 above the container 16 as the vent apertures 50 are not occluded by the ledge 52. Rather, the outermost edge of rim 48 rests securely on the shoulder 52 of the base 14.

The present invention contemplates other means of providing such venting. For example, as illustrated in FIG. 4, the upper edge of rim 22 can include an irregular surface, such as the illustrated protrusions 54, which create air gaps between the rim 48 and ledge 22, such that air can flow therethrough and around the rim 48 of the container 16 so that cool air is introduced above the container 16. In such instance, the lower edge 56 of the lid 18 is configured so as to engage an outer surface of the base 14 and provide an air passageway around the rim 48 of the container 16. Yet other means may be used, as would be appreciated by those skilled in the art, for creating such vent means.

The lid 18 is preferably comprised of a durable and transparent or translucent material, such as glass or plastic. Preferably, the lid 18 is comprised of a material that has insulating qualities to maintain the cool internal cavity temperature. As illustrated in FIG. 3, the lid 18 may in fact comprise a dual pane lid having two walls 58 and 60 with an insulating space 62 therebetween. The lowermost edge of the lid 18 cooperatively mates with the rim 22 of base 14 such that the contents of the container 16 are covered. Preferably, the lid 18 and base 14 form a generally air-tight seal there between for maintaining the internal temperature of the apparatus 10. Rubber gaskets or seals may be used to facilitate this characteristic. A handle 64 is formed with or otherwise attached to the lid 18 to allow its easy removal of the lid 18 from base 14 to access the food within container 16.

A thermostat 66, or other temperature control mechanism, is preferably coupled to the refrigeration unit 30 so as to control the temperature within the apparatus 10. Thus, food within container 16 can be cooled to varying temperatures to prevent spoilage thereof, while increasing efficiency of the unit. The use of a thermostatically controlled apparatus 10 having a generally air-tight seal enables the apparatus 10 to be placed on a counter top and run continually 24 hours a day while maintaining its energy efficiency. Of course, the thermostatic 66 can be used to quickly cool the internal cavity 24, and then be adjusted later to merely keep the food cool to increase energy efficiency.

The outer surface of base 14 is preferably painted or otherwise decorated so that the apparatus 10 is attractive in one's home. Such decoration will also render the apparatus 10 esthetically pleasing in other settings, such as potluck dinners, social gatherings, and catering situations.

In use, the appropriate food container 16 is selected for the food to be cooled. For example, the colander container 44 may be used for oranges, apples, grapes, or vegetables. Alternatively, as described above, a solid food container 16 is used for other food items such as jell-O, ambrosia, salads, etc. The food-filled container 16 is then placed in base 14 and with lid 18 positioned thereover. The unit 10 is then powered, such as by plugging cord 38 into an electrical outlet, and the proper temperature is selected via thermostat 66. The food can thus be stored conveniently until it is to be transported or eaten. Such is particularly convenient for items which would otherwise become forgotten in a large refrigerator. It is believed that waste from food spoilage would be significantly reduced by using the apparatus 10 of the present invention due to its convenient location on the counter top where family members can readily view the contents thereof through transparent lid 18.

Of course, the apparatus 10 of the present invention can also be used during pot-luck dinners, social gatherings, or by caterers. The apparatus 10 is merely powered and the lid 18 placed on the base 14 to protect the food within container 16 until it is ready for serving. Thus, the apparatus 10 of the present invention can keep food chilled and appetizing even in very adverse conditions, such as the summer heat of a picnic or outdoor party. After a social event, such as in one's home, the host or hostess can go to bed without having to place all of the food in the refrigerator as the food is maintained at the appropriate temperature by the apparatus 10 of the present invention. The apparatus 10 of the present invention overcomes many of the disadvantages of the prior art in that the cool air introduced above the container 16 prevents wilting and drying of the food which imparts in a very unattractive and unappetizing in other such devices. The apparatus 10 of the present invention can chill food for prolonged periods of time, even continuously, so long as adequate power is supplied thereto. The apparatus 10 of the present invention does so without the accompanying mess associated with cold water or ice arrangements used in the prior art.

Although several embodiments have been described in detail for purposes of illustration, various modifications may be made without departing from the scope and spirit of the invention. Accordingly, the invention is not to be limited, except as by the appended claims.

What is claimed is:

1. A portable refrigeration apparatus, comprising a base having a circumferential wall defining an open interior cavity;

a lid positionable over the food container;

an electric refrigeration unit operably disposed in the base for cooling the contents of the interior cavity; and a food container configured to be removably disposed within the interior cavity of the base;

wherein the lid is configured to be removably placed onto an upper edge of the base and form a generally air tight seal there between.

2. The apparatus of claim 1, including a vent formed between the base and the food container to permit cool air to flow above the food container.

3. The apparatus of claim 2, wherein the vent comprises apertures formed in an upper portion or rim of the food container for permitting cool air to flow therethrough.

4. The apparatus of claim 2, wherein the vent comprises an irregular ledge supporting a rim of the food container to permit passage of cool air between the base and the rim of the food container.

5. A portable refrigeration apparatus, comprising:

a base having a circumferential wall defining an open interior cavity;

an electric refrigeration unit operably disposed in the base for cooling the contents of the interior cavity; and a food container configured to be removably disposed within the interior cavity of the base;

wherein the base is insulated; and wherein the circumferential wall of the base comprises a dual wall having an insulating space therebetween.

6. The apparatus of claim 1, including a wall having apertures disposed between the refrigeration unit and the food container.

7. A portable refrigeration apparatus, comprising:

a base having a circumferential wall defining an open interior cavity;

a lid positionable over the food container;

an electric refrigeration unit operably disposed in the base for cooling the contents of the interior cavity; and a food container configured to be removably disposed within the interior cavity of the base;

wherein the food container is compartmentalized to accommodate different food items.

8. The apparatus of claim 1, wherein the food container includes a plurality of apertures therethrough for permitting cool air to flow into the food container.

9. A portable refrigeration apparatus, comprising:

a base having a circumferential wall defining an open interior cavity;

a lid positionable over the food container;

an electric refrigeration unit operably disposed in the base for cooling the contents of the interior cavity; and a food container configured to be removably disposed within the interior cavity of the base;

wherein the refrigeration unit comprises a compressor, a cooling coil coupled to the compressor and a fan for directing cool air into the interior cavity.

10. The apparatus of claim 1, including a temperature control mechanism coupled to the refrigeration unit.

11. A portable refrigeration apparatus, comprising:

a base having an insulated circumferential wall defining an open interior cavity;

an electric refrigeration unit operably disposed in the base for cooling the contents of the interior cavity, the refrigeration unit comprising a compressor, a cooling coil coupled to the compressor and a fan for directing cool air into the interior cavity;

a food container configured to be removably disposed within the interior cavity of the base and create a cool air passageway between the food container and an inner wall of the base;

a lid configured to be removably placed onto an upper edge of the base so as to be positionable over the food container and form a generally air-tight seal there between; and a temperature control mechanism coupled to the refrigeration unit.

12. The apparatus of claim 11, including a vent formed between the base and a rim or upper portion of the food container to permit cool air to flow above the food container.

13. The apparatus of claim 12, wherein the vent comprises apertures formed in the upper portion or rim of the food container for permitting cool air to flow therethrough.

14. The apparatus of claim 12, wherein the vent comprises protrusions or depressions formed in an upper edge of the base to permit passage of cool air between the base and an upper edge of the food container.

15. The apparatus of claim 11, including a wall having apertures disposed between the refrigeration unit and the food container.

16. The apparatus of claim 11, wherein the food container is compartmentalized to accommodate different food items.

17. The apparatus of claim 11, wherein the food container includes a plurality of apertures therethrough for permitting cool air to into the food container.

18. A portable refrigeration apparatus, comprising:

an insulted base having an circumferential wall defining an open interior cavity and an upper edge;

an electric refrigeration unit operably disposed in the base for cooling the contents of the interior cavity, the refrigeration unit comprising a compressor, a cooling coil coupled to the compressor and a fan for directing cool air into the interior cavity;

a wall having apertures disposed above the refrigeration unit;

a food container having a rim configured to be removably disposed on the upper edge of the base so as to support the food container within the interior cavity and create a cool air passageway between the food container and an inner wall of the base;

a lid configured to be removably placed onto an upper edge of the base and create a generally air-tight seal there between; and a temperature control mechanism coupled to the refrigeration unit.

19. The apparatus of claim 18, wherein the food container is compartmentalized to accommodate different food items.

20. The apparatus of claim 18, wherein the food container includes a plurality of apertures therethrough for permitting cool air to into the food container.

21. The apparatus of claim 18, including a vent formed between the food container and the base for permitting cool air to flow above the food container.

* * * * *